US011173538B2

(12) United States Patent
Perry et al.

(10) Patent No.: US 11,173,538 B2
(45) Date of Patent: Nov. 16, 2021

(54) WIRE BENDER WITH SELF ALIGNED REMOVABLE BEND PIN ASSEMBLY

(71) Applicant: Pensa Labs, Inc., Brooklyn, NY (US)

(72) Inventors: Marco Perry, Brooklyn, NY (US); Oscar Frias, Brooklyn, NY (US)

(73) Assignee: PENSA LABS, INC., Brooklyn, NY (US)

( * ) Notice: Subject to any disclaimer, the term of this patent is extended or adjusted under 35 U.S.C. 154(b) by 205 days.

(21) Appl. No.: 16/740,265

(22) Filed: Jan. 10, 2020

(65) Prior Publication Data

US 2020/0222968 A1 Jul. 16, 2020

Related U.S. Application Data

(60) Provisional application No. 62/791,573, filed on Jan. 11, 2019.

(51) Int. Cl.
*B21F 1/00* (2006.01)

(52) U.S. Cl.
CPC ..... *B21F 1/008* (2013.01); *B21F 1/006* (2013.01)

(58) Field of Classification Search
CPC . B21F 1/00; B21F 1/006; B21F 1/008; B21D 7/02; B21D 7/022; B21D 7/024; B23Q 1/42
See application file for complete search history.

(56) References Cited

U.S. PATENT DOCUMENTS 3,245,433 A 4/1966 Taylor
3,680,347 A * 8/1972 Schenck ..... B21D 11/12 72/217
4,091,845 A 5/1978 Johnson
4,798,073 A 1/1989 Dischler
4,996,866 A * 3/1991 Masera ..... B21D 7/022 72/214

(Continued)

FOREIGN PATENT DOCUMENTS

WO 2016 054189 4/2016

OTHER PUBLICATIONS

U.S. Appl. No. 16/661,951 entitled "Self Cutting Wire Bender," filed Oct. 23, 2019, Perry, et al.

(Continued)

*Primary Examiner* — Gregory D Swiatocha
*Assistant Examiner* — Bobby Yeonjin Kim
(74) *Attorney, Agent, or Firm* — DLA Piper LLP (US)

(57) ABSTRACT

A device for bending wire includes a first plate with upper and lower surfaces and a center aperture extending therebetween. A cavity is formed in the upper surface that includes opposing sidewalls with a separation that decreases as they extend towards the center aperture and decreases as they extend up from a bottom surface of the cavity. A pin assembly disposed in the cavity includes a second plate having a pin extending from a top surface and having opposing side surfaces with a separation that decreases as they extend towards the center aperture and decreases as they extend up toward the top surface. A shaft extends through the center aperture and terminates in a bend head having a wire aperture and first and second bend surfaces adjacent the wire aperture. A first motor is configured to rotate the first plate about the shaft in opposing first and second rotational directions.

21 Claims, 18 Drawing Sheets

(56) References Cited

U.S. PATENT DOCUMENTS

| | | | | |
|---|---|---|---|---|
| 5,088,310 | A | 2/1992 | Anagnostopoulu | |
| 5,203,192 | A * | 4/1993 | Kimura | B21D 11/12 72/21.3 |
| 5,809,824 | A | 9/1998 | Hiltzman et al. | |
| 7,188,504 | B2 | 3/2007 | Latour | |
| 8,333,097 | B1 | 12/2012 | Frear | |
| 10,427,208 | B2 | 10/2019 | Perry | |
| 10,441,984 | B1 * | 10/2019 | Brochman | B21D 7/063 |
| 2005/0076694 | A1 * | 4/2005 | Latour | B21D 7/022 72/307 |
| 2010/0147048 | A1 * | 6/2010 | Christofilis | B21D 11/12 72/372 |
| 2010/0219573 | A1 * | 9/2010 | O'Rell | B25B 5/10 269/246 |
| 2014/0130567 | A1 | 5/2014 | Christofillis | |
| 2017/0159697 | A1 * | 6/2017 | Hoogstrate | B23Q 1/42 |
| 2017/0274442 | A1 * | 9/2017 | Perry | B21F 1/00 |
| 2017/0325854 | A1 * | 11/2017 | Rouge | B21D 7/024 |

OTHER PUBLICATIONS

Pensa Labs, "DIWire Bender," YouTube, May 2, 2012, [video online], Retrieved from the Internet: https://www.youtube.com/watch?v=velzzDXlJoA&t=1s.

Pensa Labs, "DIWire, Now on Kickstarter," YouTube, Dec. 6, 2013, [video online], [retrieved on Nov. 23, 2015], Retrieved from the Internet: URL:https://www.youtube.com/watch?v=0jG4SWcThBc.

* cited by examiner

WIRE BENDER WITH SELF ALIGNED REMOVABLE BEND PIN ASSEMBLY

RELATED APPLICATIONS

This application claims the benefit of U.S. Provisional Application No. 62/791,573 filed on Jan. 11, 2019, and which is incorporated herein by reference.

FIELD OF THE INVENTION

The present invention relates to devices that bend wire into desired shapes.

BACKGROUND OF THE INVENTION

Wire benders are devices that bend wire into desired 2-dimensional or 3-dimensional shapes. Early wire benders provided a mechanism that allowed a user to manually bend wire into desired shapes. See for example U.S. Pat. Nos. 4,091,845 and 5,809,824. More recently, motorized wire benders have been developed that use a moving pin under motor control to bend wire, some even operating under computer control. See for example U.S. Pat. No. 5,088,310. Drawbacks of such devices, however, include excessive expense, complexity and size. Additionally, such devices are difficult to set up and operate for each desired wire shape, especially when the wire shape is completed and needs extraction from the wire feed (which traditionally is done manually by hand).

There is a need for a wire bender device design that is simple and relatively inexpensive and easy to operate, so that wire shapes can be effectively and efficiently created and extracted.

BRIEF SUMMARY OF THE INVENTION

The aforementioned problems and needs are addressed by a device for bending wire that includes a first plate, a pin assembly, a shaft and a first motor. The first plate includes upper and lower surfaces with a center aperture extending there between, and a cavity formed in the upper surface that includes opposing sidewalls extending up from a bottom surface of the cavity, wherein a separation of the opposing sidewalls decreases as the opposing sidewalls extend towards the center aperture, and a separation of the opposing sidewalls decreases as the opposing sidewalls extend up from the bottom surface of the cavity. The pin assembly is disposed in the cavity and includes a second plate having opposing side surfaces and top and bottom surfaces, and a pin extending from the top surface, wherein a separation of the opposing side surfaces decreases as the opposing side surfaces extend towards the center aperture, and wherein a separation of the opposing side surfaces decreases as the opposing side surfaces extend up toward the top surface. The shaft extends through the center aperture and terminates in a bend head. The bend head includes a wire aperture configured to pass a wire, and first and second bend surfaces positioned adjacent the wire aperture. The first motor is configured to rotate the first plate about the shaft in opposing first and second rotational directions.

A device for bending wire includes a first plate, a pin assembly, a shaft and a first motor. The first plate includes upper and lower surfaces with a center aperture extending there between, and a cavity formed in the upper surface that includes opposing sidewalls extending up from a bottom surface of the cavity, wherein a separation of the opposing sidewalls decreases as the opposing sidewalls extend towards the center aperture, and wherein a separation of the opposing sidewalls decreases as the opposing sidewalls extend up from the bottom surface of the cavity. The pin assembly is configured for insertion in the cavity and includes a second plate having opposing side surfaces and top and bottom surfaces, a pin extending from the top surface and adjacent a first end of the second plate, wherein a separation of the opposing side surfaces decreases as the opposing side surfaces extend towards the first end, and wherein a separation of the opposing side surfaces decreases as the opposing side surfaces extend up toward the top surface. Upon insertion of the pin assembly in the cavity, the opposing side surfaces configured to engage with the opposing sidewalls. The shaft extends through the center aperture and terminates in a bend head. The bend head includes a wire aperture configured to pass a wire, and first and second bend surfaces positioned adjacent the wire aperture. The first motor is configured to rotate the first plate about the shaft in opposing first and second rotational directions.

Other objects and features of the present invention will become apparent by a review of the specification, claims and appended figures.

DETAILED DESCRIPTION OF THE INVENTION

Figure 1:
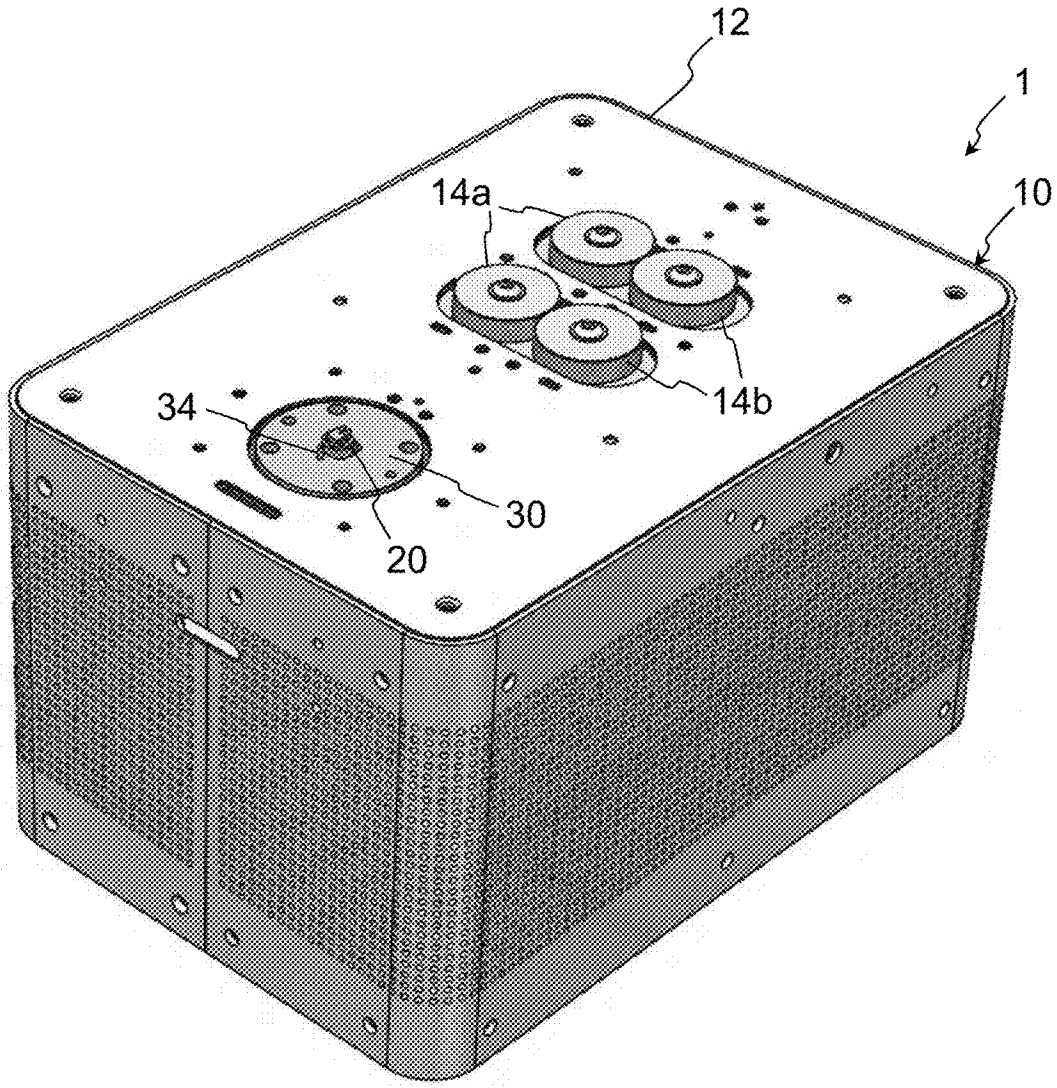
FIG. 1 is a perspective view of the wire bender apparatus.

The present embodiment is a desktop sized wire bender that converts drawn curves into bent wire having 2-dimensional or 3-dimensional shapes. The wire bender 1 is shown in FIG. 1, and includes a housing 10 having a top plate 12.

The top plate 12 serves as a work surface on which the wire manipulation components are positioned. These components include two pairs of feed wheels, with each pair including two wheels 14*a* and 14*b* that pinch and manipulate the wire fed there between.

Figure 2:
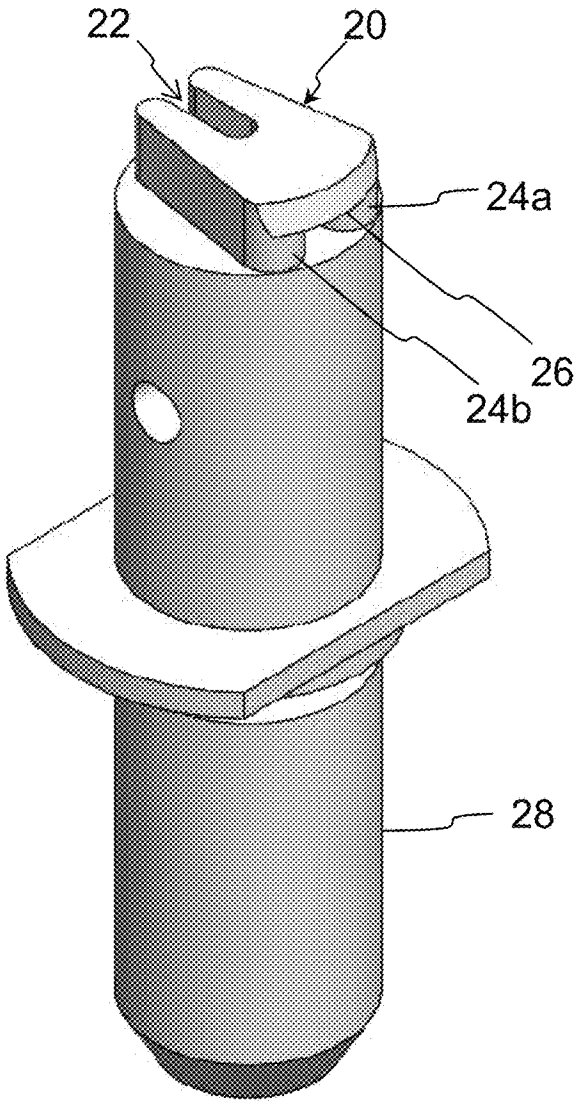
FIG. 2 is a perspective view of the bend head and shaft.

A bend head 20 is positioned to receive the wire fed from the pairs of feed wheels. The bend head 20 is better shown in FIG. 2, and includes an aperture 22 through which the wire can be fed to hold the wire in place while it is being bent. Bend head 20 also includes a pair of bend surfaces 24*a* and 24*b*, one on each side of the aperture 22. Above the aperture 22 and between the bend surfaces 24*a*/24*b* is a cutting edge 26 (preferably enhanced by a less than 90 degree angle between the top surface of the aperture and the side wall which defines the cutting edge). The bend head 20 is positioned at the top of a shaft 28.

Figure 3:
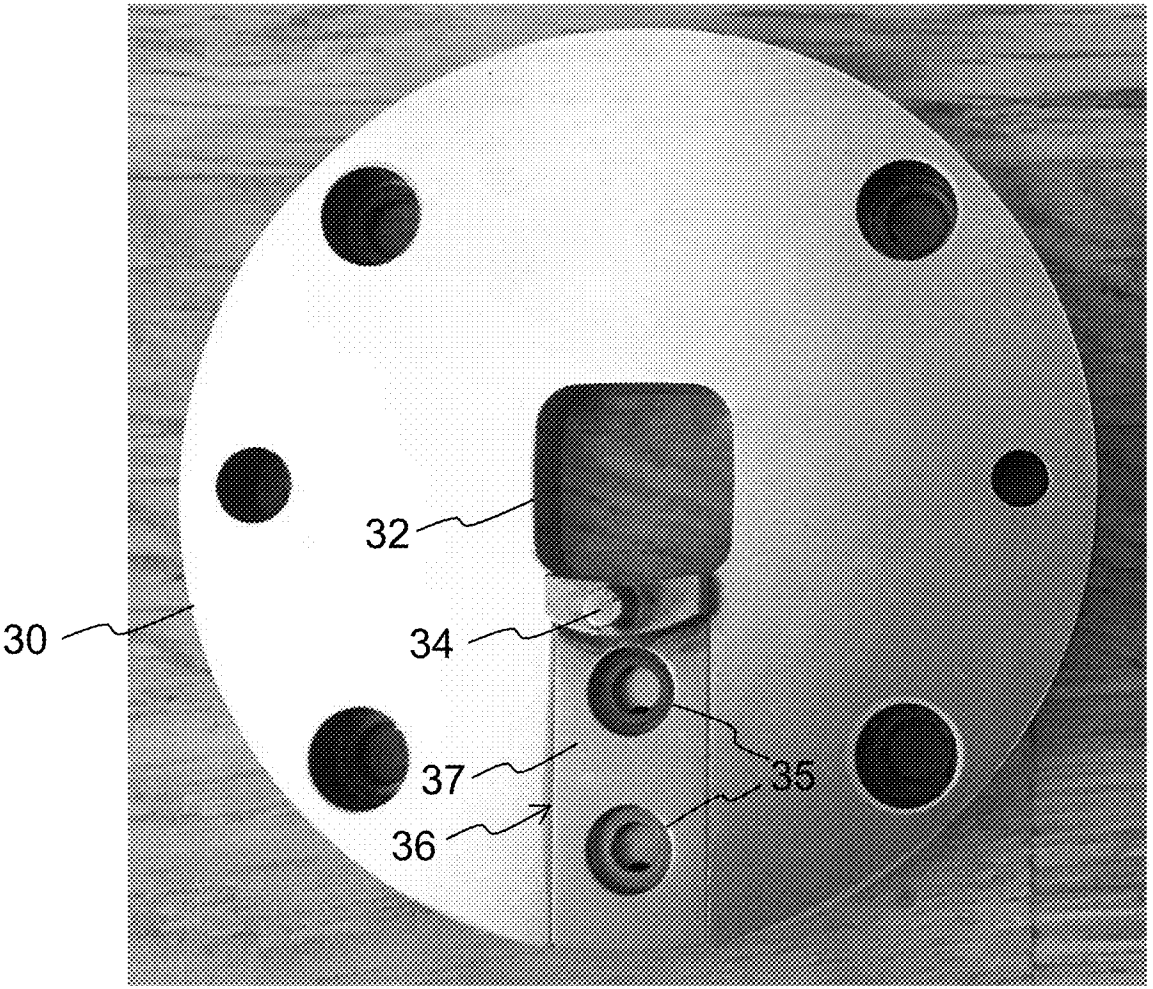
FIG. 3 is a top view of the rotatable plate.
Figure 4:
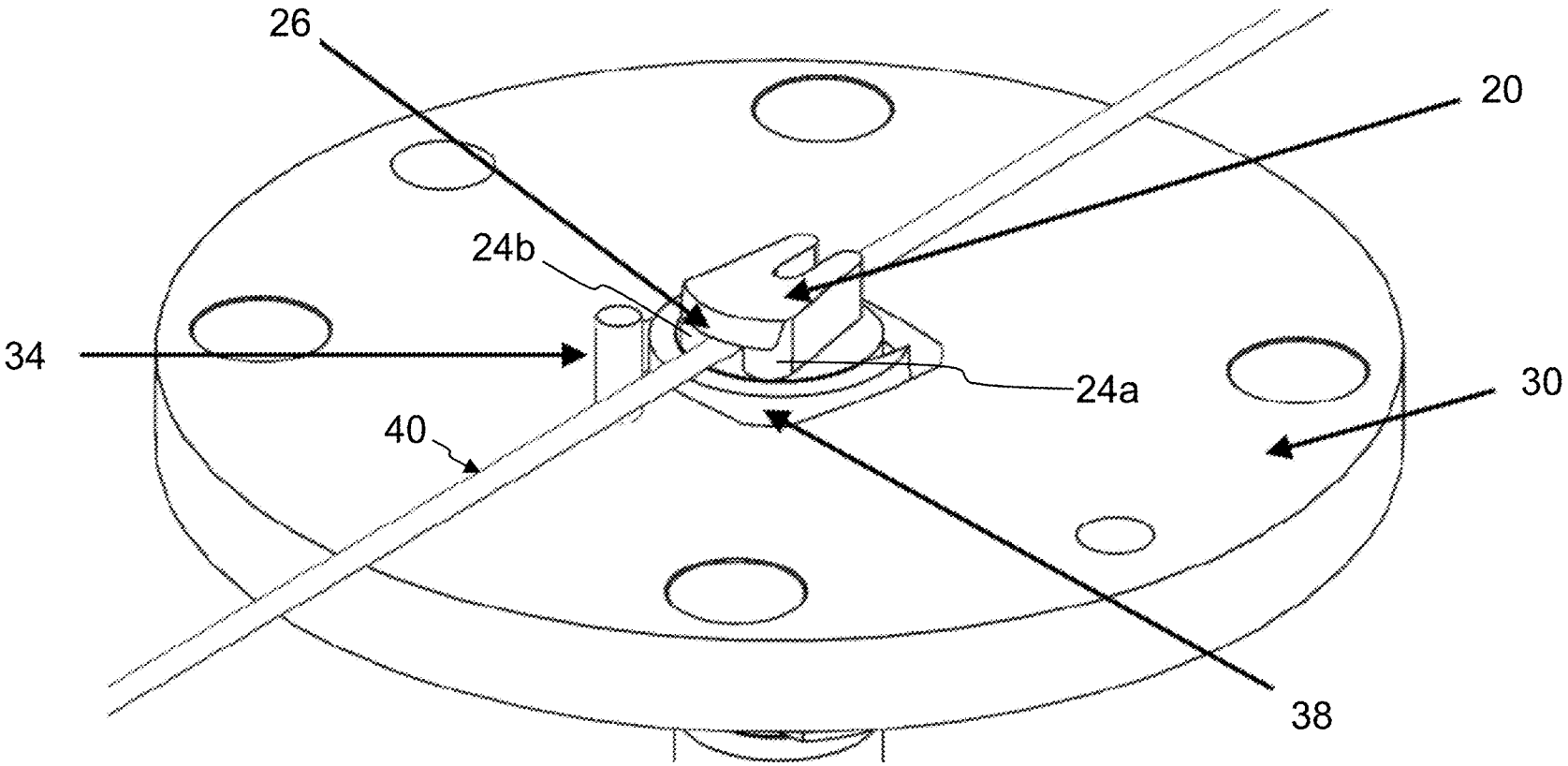
FIG. 4 is a perspective view of the bend head and rotatable plate.

Shaft 28 protrudes through a center aperture 32 of a plate 30, as best shown in FIGS. 3-4. Plate 30 preferably has a circular out edge. Plate 30 has upper and lower surfaces, and includes an upwardly protruding pin 34 closely adjacent the aperture 32. Pin 34 can be integrally formed as part of plate 30, or part of an assembly that mounts to plate 30 as best shown in FIG. 3. Pin 34 travels (translates) in an arch shape path relative to the bend head 20 by rotation of the plate 30 about its center aperture 32. Shaft 28 also protrudes through a hollow sleeve 38 to be explained in further detail below.

Figure 5B:
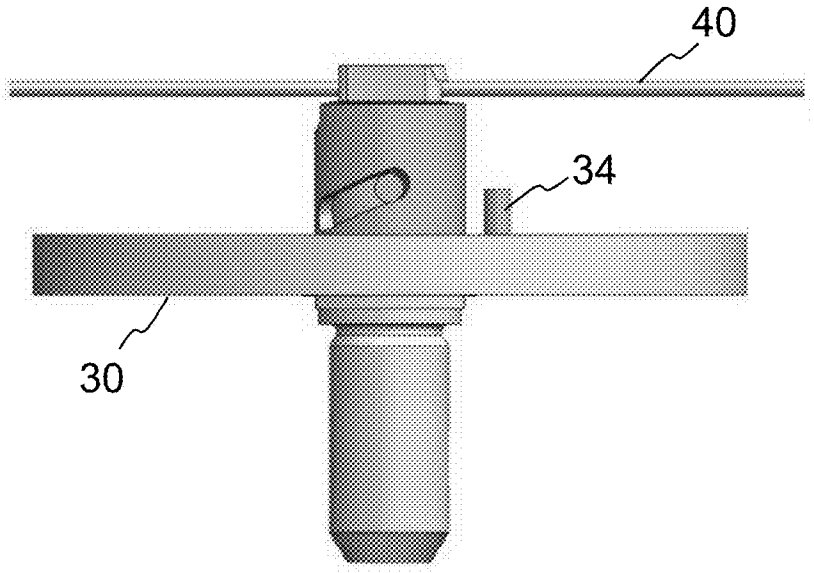
FIG. 5B is a side view of the rotatable plate in its retracted position.
Figure 5A:
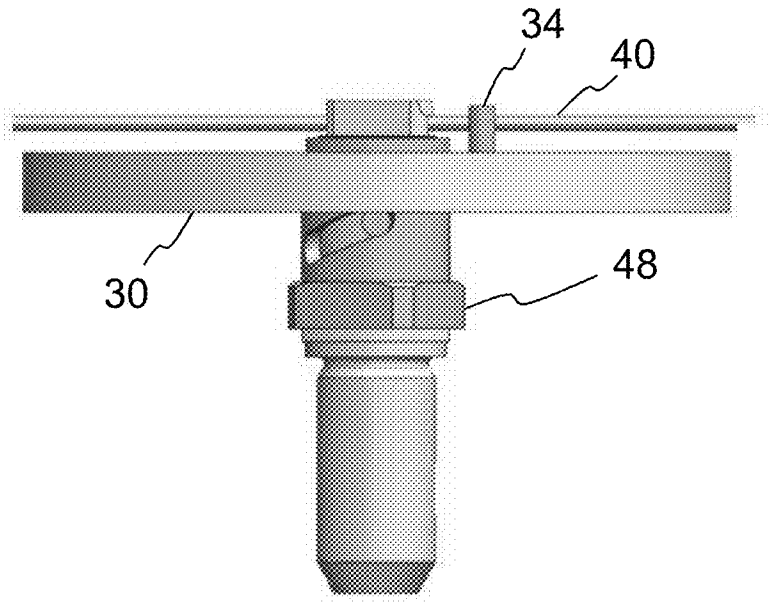
FIG. 5A is a side view of the rotatable plate in its extended position.

FIG. 4 shows wire 40 extending through the aperture 22 of bend head 20 and out beyond the bend surfaces 24*a*/24*b*. The pin 34 is shown positioned at the point it makes initial contact with the wire 40. The plate 30 is then rotated counterclockwise from the position shown in FIG. 4, which causes the pin 34 to travel in front of aperture 22 and push on wire 40 (wrapping the wire 40 around bend surface 24*a*) until the desired bend shape is achieved in the wire. At that point, pin 34 retreats away from wire 40 by rotating plate 30 in the opposite direction. Thereafter, the wire 40 is advanced by the feed wheels 14*a*/14*b* to the next target location of the wire to be bent. To implement bends in the opposite direction, the plate 30 lowers vertically down to a semi-retracted (intermediate) position so that the pin 34 can travel underneath the aperture 22 and therefore underneath the wire without engaging it, where plate 30 then rises vertically to its raised (extended) position and rotates clockwise so that pin 34 passes in front of the aperture 22 and engages wire 40 from the other side and pushes on wire 40 (wrapping the wire around bend surface 24*b*) until the desired bend shape is achieved in the wire. FIG. 5A shows the plate 30 in its raised (extended) position (where pin 34 will engage with and bend wire 40 upon rotation of the plate 30). FIG. 5B shows the plate 30 in a fully retracted position used for cutting as further described below. The intermediate position is between those shown in FIGS. 5A and 5B.

Plate Retraction and Wire Cutting

Figure 6:
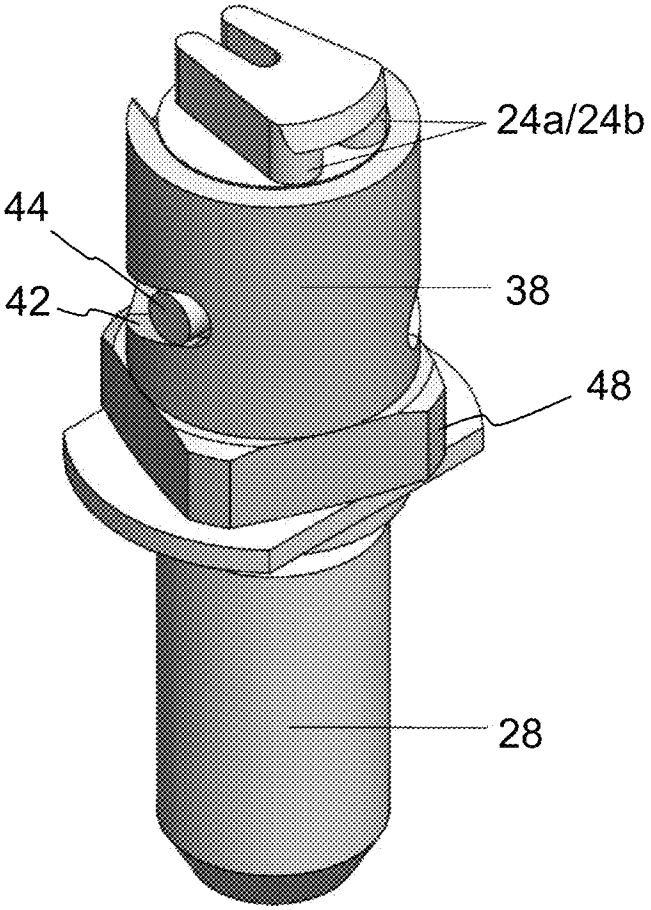
FIG. 6 is a perspective view of the sleeve mounted around the shaft.
Figures 7A, 7B, 7C:
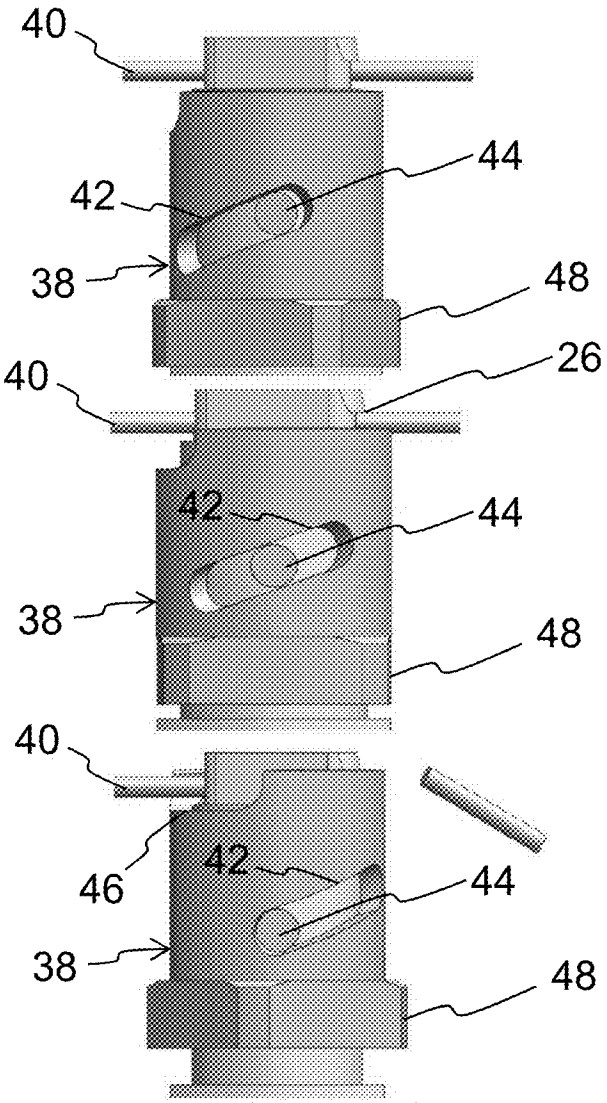
FIGS. 7A-7C are side views showing the different vertical positions of the sleeve relative to the shaft.

FIG. 6 shows that shaft 28 is disposed inside of sleeve 38, which rotates about shaft 28. Sleeve 38 includes a sloping cam slot 42 which engages with a cam pin 44 extending out of shaft 28. Rotation of the sleeve 38 about shaft 28 in one direction causes pin 44 to engage with the upper sloping side of cam slot 42 to move the sleeve upwardly relative to the shaft 28 (from a retracted position to an extended position). Rotation of the sleeve 38 about shaft 28 in the other direction causes pin 44 to engage with the lower sloping side of cam slot 42 to move the sleeve downwardly relative to the shaft 28 (from the extended position to the retracted position). FIG. 7A shows sleeve 38 in the retracted position. FIG. 7B shows sleeve 38 in its intermediate position (e.g., traveling from the retracted position to the extended position). FIG. 7C shows sleeve 38 in the extended position. As the sleeve reaches the extended position, the sleeve's top edge engages with the wire 40 extending out of the aperture 22, pressing it against cutting edge 26, which cuts the wire off as the top edge of sleeve 38 passes cutting edge 26 (as shown in FIG. 7C). The top edge of sleeve 38 includes a notch or recess 46 so that the sleeve does not engage the portion of the wire feeding into the other side of aperture 22. This configuration is advantageous because it cuts the wire at a location directly adjacent the bend surfaces 24*a*/24*b*, which is ideal for those desired wire shapes where the wire is to end and be cut at or very near the last bend shape. This cutting capability provides accurate cutting, and means that the user need not manually cut the wire which could be time consuming and inaccurate.

Rotation of sleeve 38 is accomplished by lowering plate 30 to its retracted position so that its center aperture 32 engages with a flange 48 of sleeve 38. Aperture 32 and flange 48 have shapes that match each other sufficiently so that rotating plate 30 causes aperture 32 engaged with flange 48 to rotate sleeve 38. The non-limiting example in the figures shows aperture 32 having a generally square shape matching a generally square shape of the lower portion of flange 48. This configuration is advantageous because the same motor used to rotate plate 30 for bending wire 40 can also be used to rotate and raise sleeve 38 for cutting wire 40.

Figure 8:
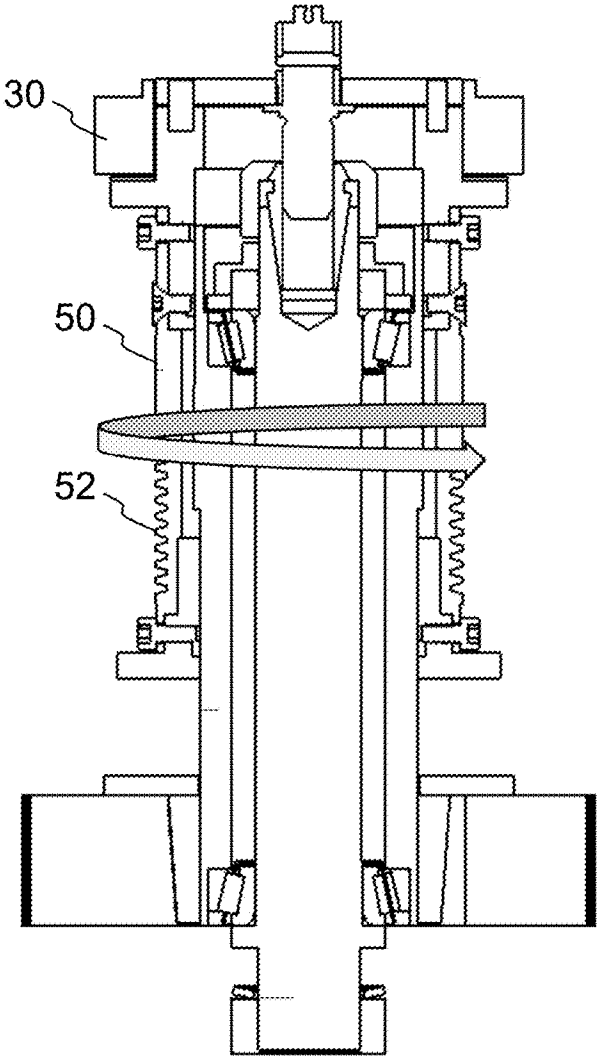
FIG. 8 is a side cross sectional view of the components used to raise and lower the rotatable plate.
Figure 9:
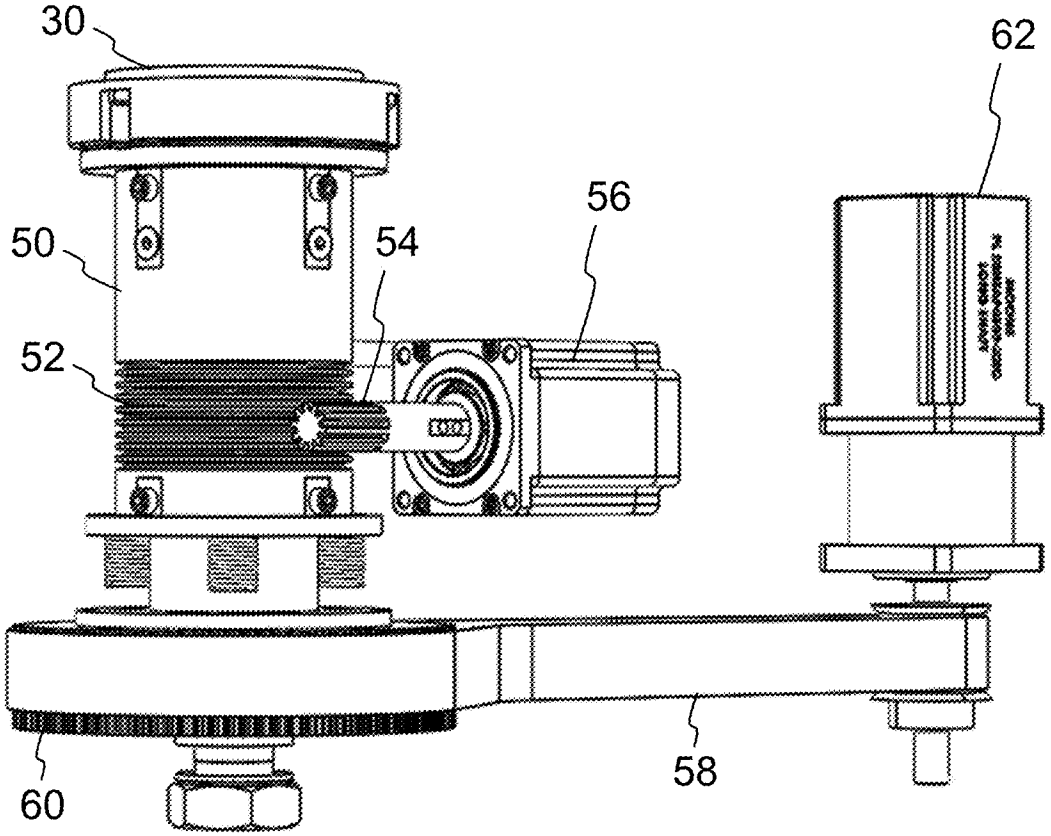
FIG. 9 is a side view of the components used to raise, lower and rotate the rotatable plate.
Figure 10:
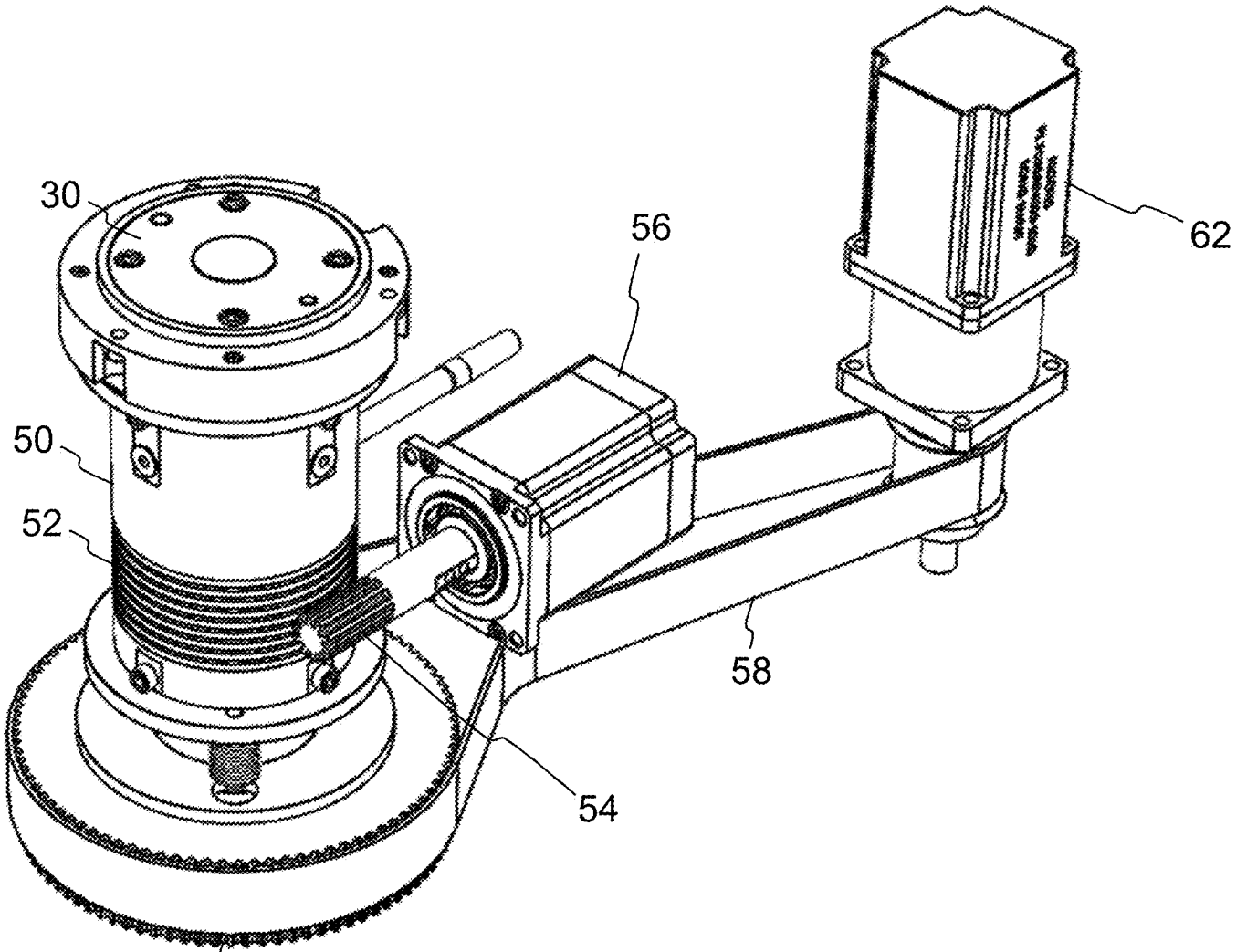
FIG. 10 is a perspective view of the components used to raise, lower and rotate the rotatable plate.

FIGS. 8-10 illustrates the structure used to raise and lower plate 30, and rotate plate 30. The plate 30 is connected to sleeve 50 that includes teeth 52 on its outer circumference. Gear 54 is engaged with teeth 52 and is driven by motor 56 to drive sleeve 50 and plate 30 vertically between three positions (a fully raised position so that pin 34 engages with wire 40, a semi-retracted position that allows the pin to pass underneath the wire without engaging it, and a fully retracted position wherein plate aperture 32 engages with sleeve flange 48 for rotating and raising sleeve 38 for cutting the wire. Rotation of plate 30 is provided by belt 58 which is engaged with sleeve 50. Preferably, belt 58 is a toothed timing belt that engages with a toothed pulley 60 connected to the sleeve 50. Motor 62 drives belt 58 to rotate sleeve 50 and plate 30. This means that three actions (raising/lowering plate 30, rotating plate 30, and rotating sleeve 38 for vertical movement) are accomplished using only two motors, driving down the complexity, size and cost of the wire bender 1. Moreover, teeth 52 preferably extend around the entire circumference of sleeve 50, so that the raising/lowering of plate 30 can be performed independently and concurrently with rotation of plate 30 (e.g., so that the plate 30 can maintain engagement with the rising flange 48 as sleeve 38 travels vertically up and down).

Bend Pin Mandrel

As shown in FIG. 3, the bend pin 34 can be part of a pin assembly 36 that removably mounts to the plate 30. Specifically, pin assembly 36 includes pin 34 extending from an upper surface of plate member 37 that includes bolt holes 35 that align with threaded holes in plate 30 (for securing plate 37 to plate 30). The pin assembly 36 can sit inside a channel 31 formed in the upper surface of the plate 30. The advantage of this embodiment is that pin assembly 36 can be removed and replaced with another pin assembly 36 having a pin 34 of a different shape (e.g. of different diameter) so that a bend pin 34 of ideal shape can be used for any given desired wire shape. A pin having one diameter may be better suited for a particular wire shape than another pin having a different diameter. For example, a pin with smaller diameter would be better suited for wire shapes with tighter bends in the wire, and a pin with a larger diameter would be better suited for wire shapes with larger radius bends.

Figure 11:
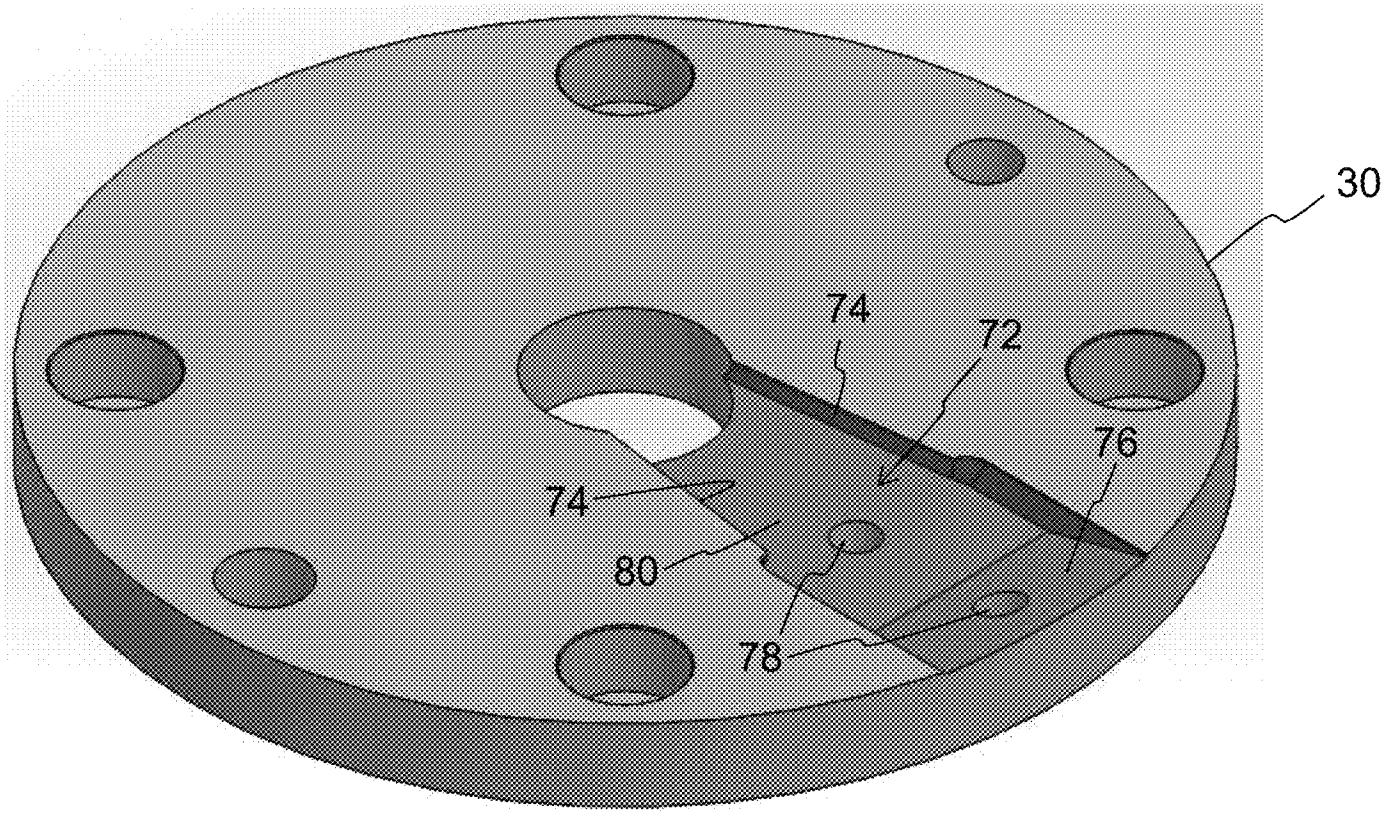
FIG. 11 is a perspective view of the pin assembly cavity formed in the upper surface of the plate.
Figure 12:
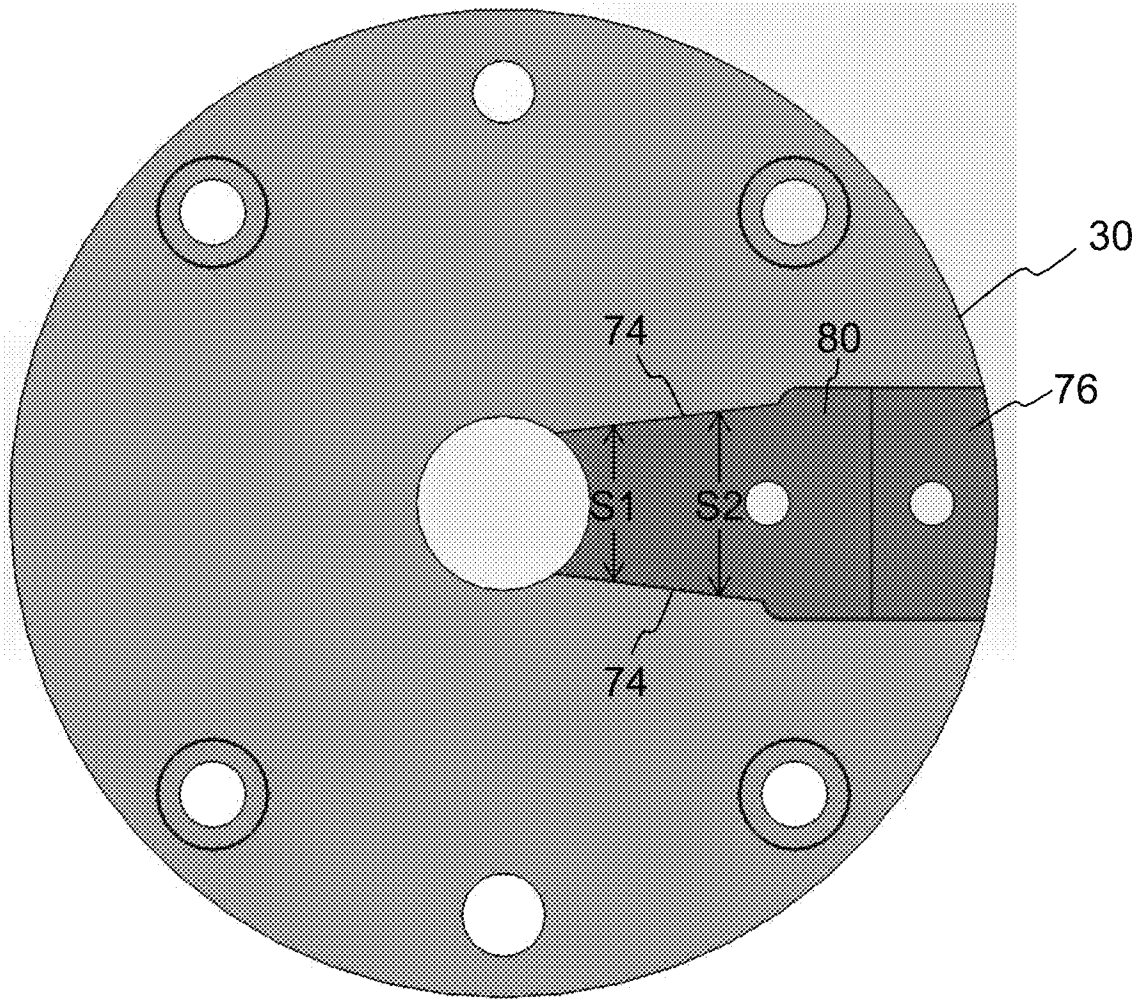
FIG. 12 is a top view of the pin assembly cavity formed in the upper surface of the plate.
Figure 13:
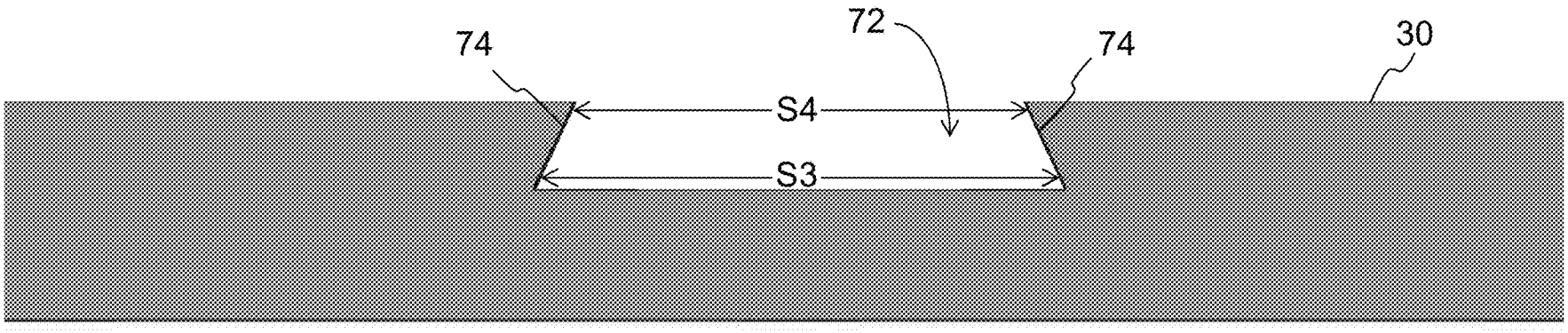
FIGS. 13-14 are side cross sectional views of the pin assembly cavity formed in the upper surface of the plate.
Figure 14:
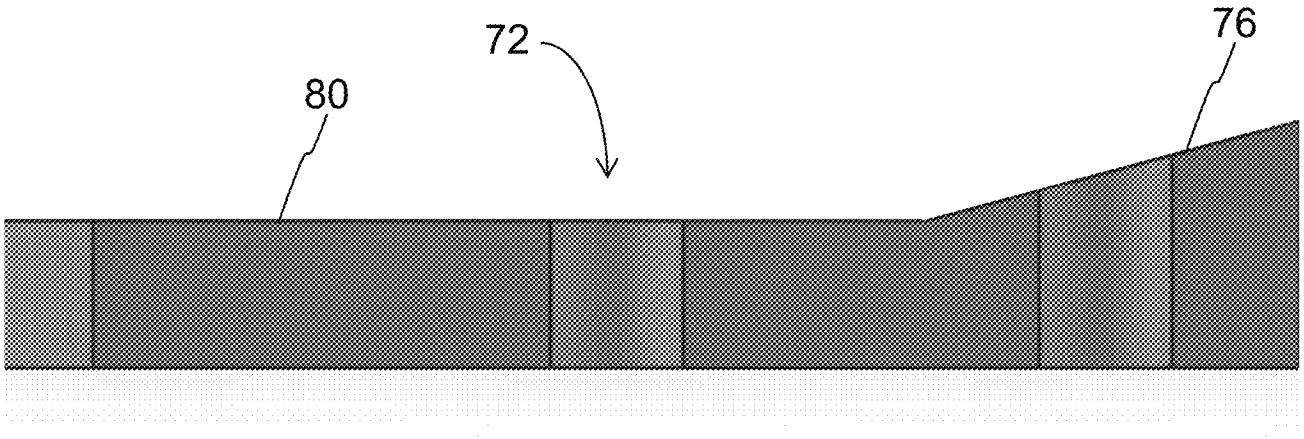

FIGS. 11-20 illustrate an alternate embodiment that includes a pin assembly 70 that is disposed in a cavity 72 formed in the upper surface of the plate 30. The cavity 72 is formed in the upper surface of the plate 30 and includes opposing sidewalls 74 and a distal wall 76. Threaded holes 78 extend into the plate from the cavity 72 (one from a bottom surface 80 of the cavity, and one from the distal wall 76), as best shown in FIGS. 11-12. Sidewalls 74 have two separate taper shapes. The first taper shape is in the plane of the plate 30, where the separation of the two walls decreases as the sidewalls 74 approach the center of the plate (i.e. separation distance 51 between the two sidewalls 74 is less than separation distance S2, as shown in FIG. 12). The second taper shape is in a plane orthogonal to the plane of plate, wherein as the sidewalls 74 extend up from the bottom surface of the cavity, they also extend toward each other (i.e., a negative slope, where separation distance S3 between the two sidewalls 74 at the bottom of the cavity 72 is greater than separation distance S4 at the top of the cavity, as shown in FIG. 13). The distal wall 76 has a third taper shape, wherein the distal wall 76 ramps upwardly as it extends away from the center of the plate 30, as best shown in FIG. 14.

Figure 16:
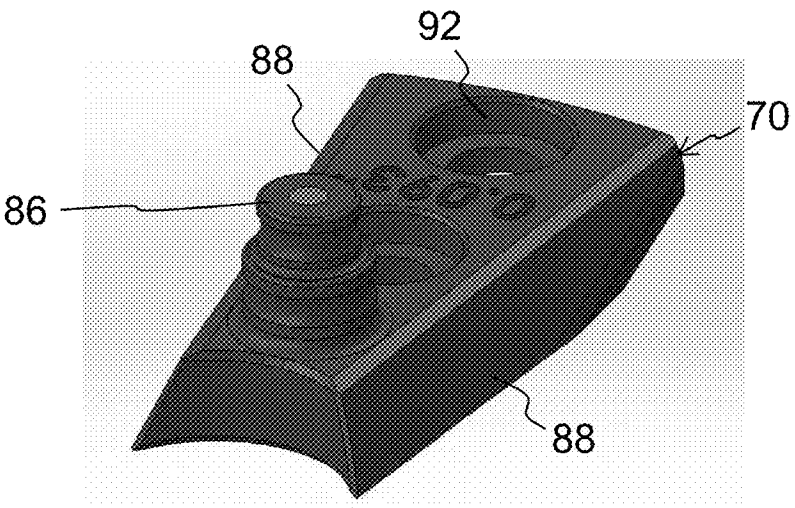
FIG. 16 is a perspective view of the pin assembly.
Figure 15:
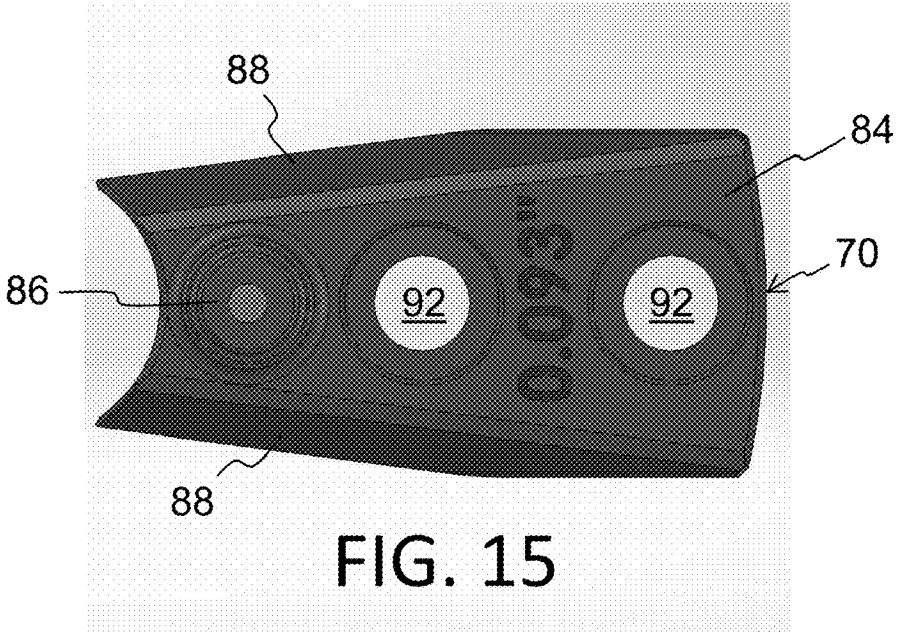
FIG. 15 is a top view of the pin assembly.
Figure 17:
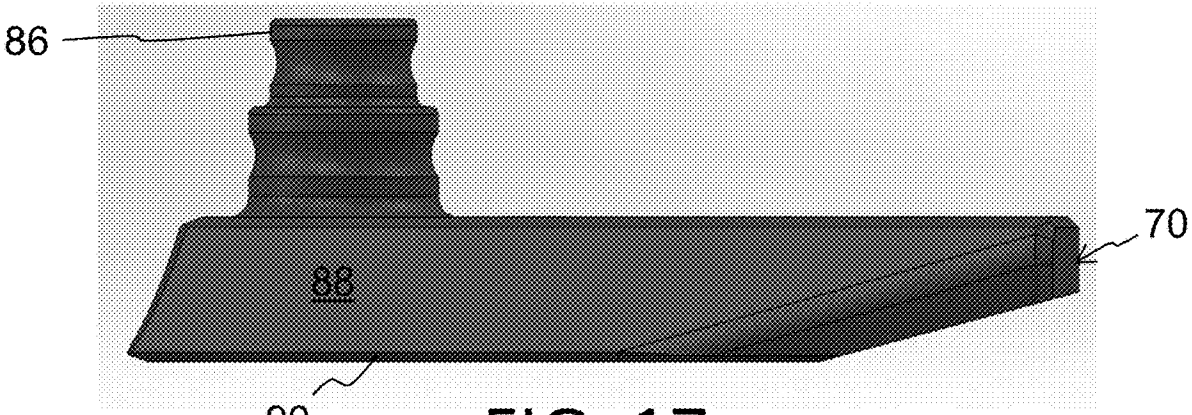
FIG. 17 is a side view of the pin assembly.

Pin assembly 70 is best shown in FIGS. 15-17, and includes a base plate 84 and a bend pin 86 extending from a top surface of the base plate 84. The base plate 84 includes opposing side surfaces 88 that match the first and second taper shapes of the cavity sidewalls 74 (i.e., side surfaces 88 have the same taper shapes as those of cavity sidewalls 74), and a bottom surface 90 that matches the combined shape of the bottom surface 80 and third taper shape of distal wall 76 of cavity 72. Base plate 84 also includes holes 92 that will align with threaded holes 78 to accommodate mounting bolts.

Figure 18:
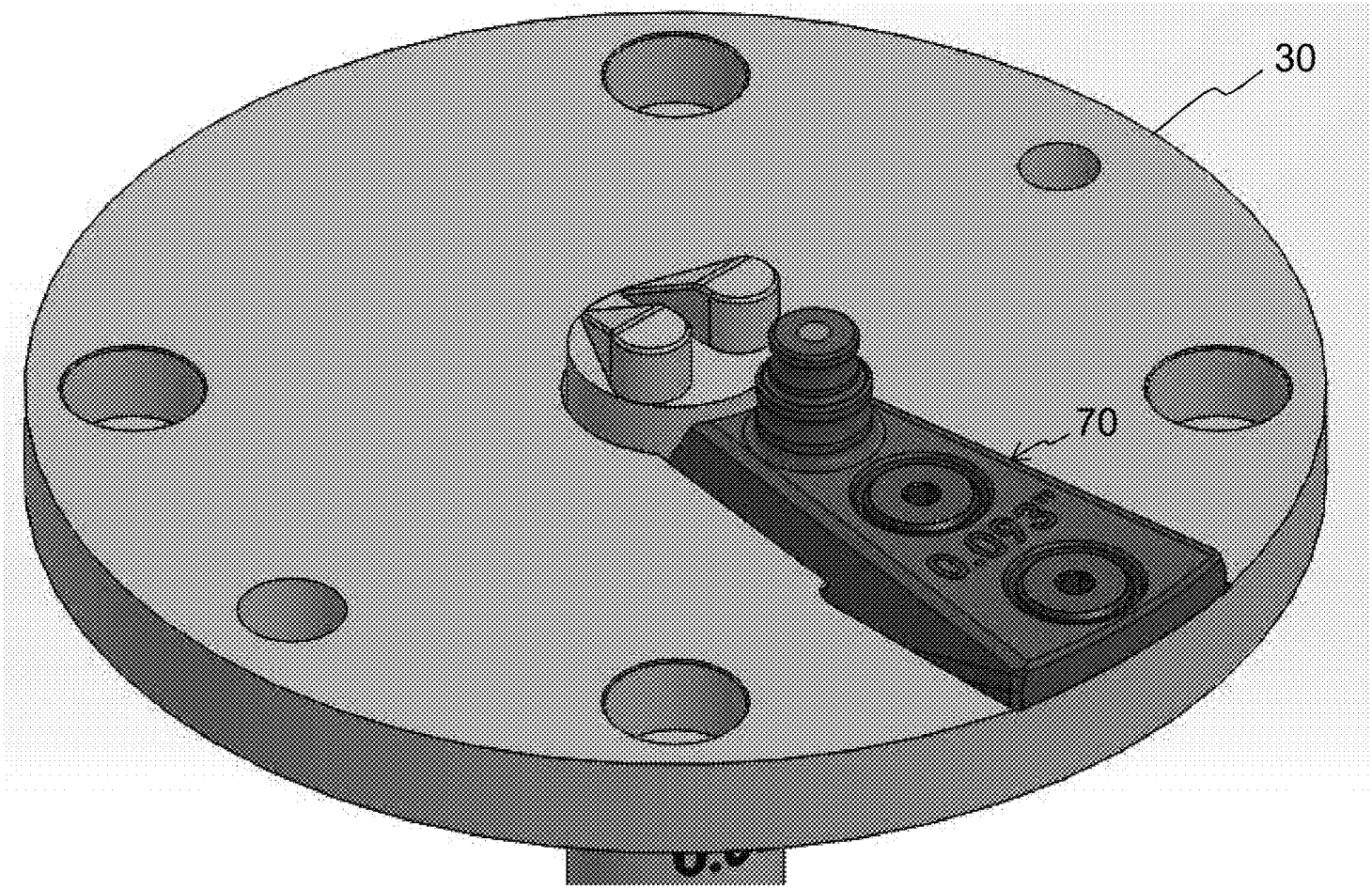
FIG. 18 is a perspective view of the pin assembly mounted in the cavity formed in the upper surface of the plate.
Figure 19:
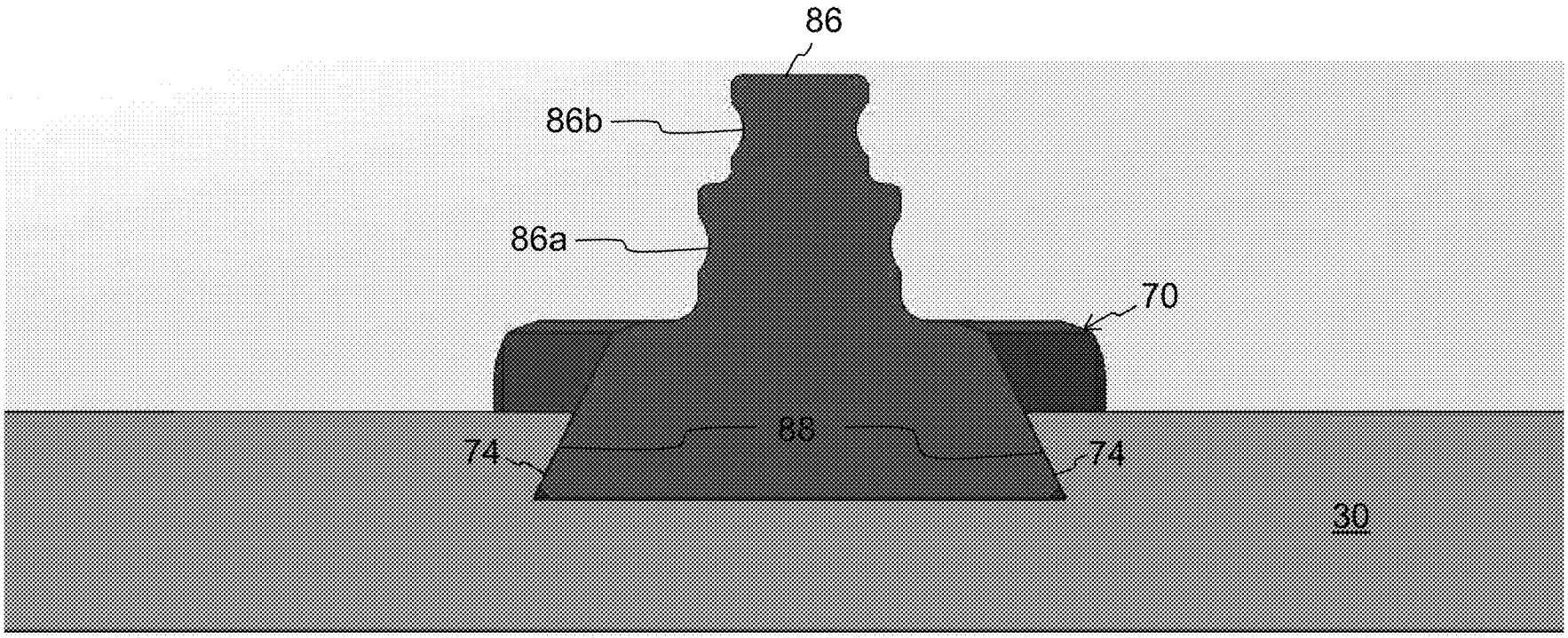
FIGS. 19-20 are side cross sectional views of the pin assembly mounted in the cavity formed in the upper surface of the plate.
Figure 20:
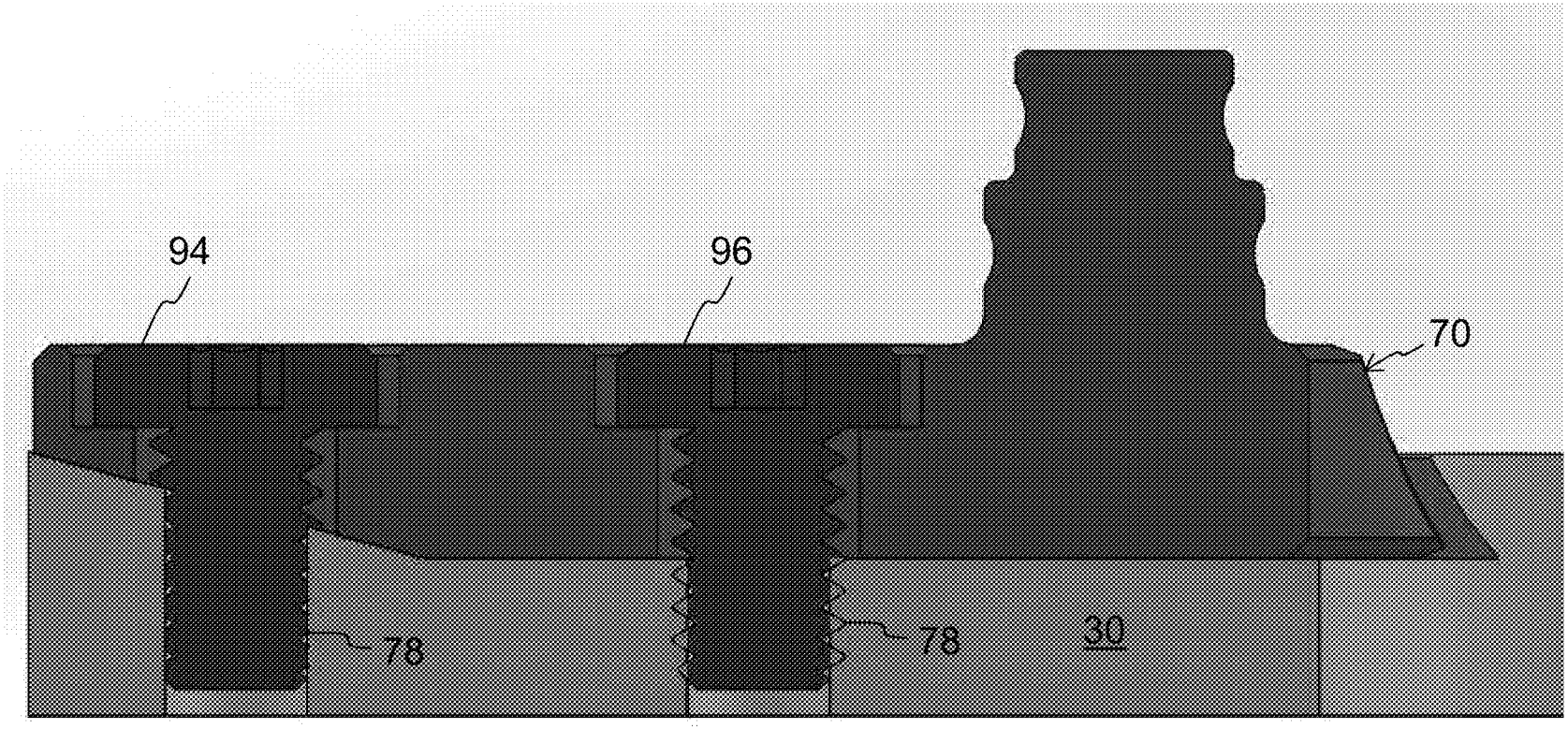

FIGS. 18-20 illustrate pin assembly 70 inserted and mounted into cavity 72. To insert pin assembly 70, it is placed into cavity 72 and slid toward the center of plate 30 until the side surfaces 88 of pin assembly 70 engage with the sidewalls 74 of cavity 72. Inserting and tightening back bolt 94 through back hole 92 and into threaded hole 78 causes bottom surface 90 to press against distal wall 76, generating a force in the direction of the center of plate 30 that presses side surfaces 88 and sidewalls 74 together. Inserting and tightening forward bolt 96 through forward hole 92 and into the other threaded hole 78 secures pin assembly 70 to the bottom surface 80 of the cavity 72.

Bend pin 86 can have different wire engaging portions each having a different radius of curvature. For example, as best shown in FIG. 19, bend pin 86 can have a first portion 86*a* with a radius of curvature that is greater than that of a second portion 86*b*. The height of plate 30 can be selected at one time to use first portion 86*a* to bend the wire (for larger radius bend shapes), and selected at another time to use the second portion 86*b* to bend the wire (for smaller radius bend shapes). This allows the wire bender 1 to automatically select different wire engaging portions of the bend pin without the user having to manually change the pin assembly 70.

There are many advantages to the various taper shapes. The location of the bend pin 86 relative to the bend head 20 is critical. Therefore, the first taper shape of the cavity and pin assembly side surfaces 88 and sidewalls 74 provides repeatable positioning (registering) of the pin assembly 70 in cavity 72 relative to the center of the plate 30, which in turn provides repeatable positioning and registration of the bend pin 86 relative to the bend head 20. The second taper shape of the cavity and pin assembly side surfaces 88 and sidewalls 74 securely holds the pin assembly to the bottom surface 80 of cavity 72 of the plate 30. The third taper shape translates the downward clamping force of the distal bolt 94 into a sideways force that forces the pin assembly 70 inwardly toward the center of the plate 30, which tightly presses the sidewalls 74 and side surfaces 88 together. The three taper shapes result in most of the forces exerted to keep the pin assembly 70 in place during wire bending are provided by the plate 30 (e.g., sidewalls 74, distal wall 76) instead of mounting bolts 94/96, which will prevent the bolts from getting jammed, stripped or sheared off. This is especially so when the bend pin 86 is operated using the further most distal bend surface 86*b*. The above described configurations provide positional accuracy of the bend pin relative to the bend head that does not rely on user skill, and eliminates inter-piece gaps that could reduce repeatable positional accuracy.

Providing the pin assembly 70 separate from the plate 30 also means that the pin assembly 70 can be made of harder material to withstand the forces of wire bending, while the larger plate 30 can be made of less hard material that is cheaper, easier to machine, and is less likely to crack.

It is to be understood that the present invention is not limited to the embodiment(s) described above and illustrated herein, but encompasses any and all variations falling within the scope of any claims. For example, references to the present invention herein are not intended to limit the scope of any claim or claim term, but instead merely make reference to one or more features that may be covered by one or more of the claims. Materials, processes and numerical examples described above are exemplary only, and should not be deemed to limit the claims. Further, as is apparent from the claims and specification, not all method steps need be performed in the exact order illustrated or claimed unless otherwise stated or evident.

It should be noted that, as used herein, the terms "over" and "on" both inclusively include "directly on" (no intermediate materials, elements or space disposed there between) and "indirectly on" (intermediate materials, elements or space disposed there between). Likewise, the term "adjacent" includes "directly adjacent" (no intermediate materials, elements or space disposed there between) and "indirectly adjacent" (intermediate materials, elements or space disposed there between), "mounted to" includes "directly mounted to" (no intermediate materials, elements or space disposed there between) and "indirectly mounted to" (intermediate materials, elements or spaced disposed there between), and "engaged with" includes "directly engaged with" and "indirectly engaged with" (intermediate components connect the elements together).

What is claimed is:

1. A device for bending wire, comprising:

a first plate that includes:

upper and lower surfaces with a center aperture extending there between, and a cavity formed in the upper surface that includes opposing sidewalls extending up from a bottom surface of the cavity, wherein a separation of the opposing sidewalls decreases as the opposing sidewalls extend towards the center aperture, and wherein a separation of the opposing sidewalls decreases as the opposing sidewalls extend up from the bottom surface of the cavity;

a pin assembly disposed in the cavity, wherein the pin assembly includes:

a second plate having opposing side surfaces and top and bottom surfaces, a pin extending from the top surface, wherein a separation of the opposing side surfaces decreases as the opposing side surfaces extend towards the center aperture, and wherein a separation of the opposing side surfaces decreases as the opposing side surfaces extend up toward the top surface;

a shaft extending through the center aperture and terminating in a bend head, wherein the bend head includes:

a wire aperture configured to pass a wire, and first and second bend surfaces positioned adjacent the wire aperture;

a first motor configured to rotate the first plate about the shaft in opposing first and second rotational directions.

2. The device of claim 1, wherein the opposing side surfaces are engaged with opposing sidewalls.

3. The device of claim 1, wherein:

the cavity includes a distal wall that extends upwardly from the bottom surface of the cavity as the distal wall extends away from the center aperture, the second plate includes a bottom surface having first portion engaged with the bottom surface of the cavity and a second portion engaged with the distal wall.

4. The device of claim 1, wherein the second plate includes a hole extending between the top and bottom surfaces, the device further comprising:

a threaded hole extending into the bottom surface of the cavity; and a threaded bolt extending through the hole and into the threaded hole.

5. The device of claim 3, wherein the second plate includes first and second holes extending between the top and bottom surfaces, the device further comprising:

a first threaded hole extending into the bottom surface of the cavity;

a second threaded hole extending into the distal wall of the cavity;

a first threaded bolt extending through the first hole and into the first threaded hole; and a second threaded bolt extending through the second hole and into the second threaded hole.

6. The device of claim 1, further comprising:

a second motor configured to move the first plate between a first position and a second position along the shaft;

wherein the first plate positioned in the first position and rotating in the first rotational direction causes the pin to travel in front of the wire aperture;

wherein the first plate positioned in the second position and rotating in the first rotational direction causes the pin to travel underneath the wire aperture.

7. The device of claim 6, further comprising:

a pair of opposing wheels positioned for feeding wire through the wire aperture, wherein the first plate positioned in the first position and rotating in the first rotational direction causes the pin to bend the wire fed through the wire aperture against the first bend surface.

8. The device of claim 7, wherein the first plate positioned in the second position and rotating in the second rotational direction causes the pin to pass underneath and not engage with the wire fed through the wire aperture.

9. The device of claim 1, wherein the pin has a first portion with a first radius of curvature and a second portion with a second radius of curvature different than the first radius of curvature.

10. The device of claim 9, further comprising:

a second motor configured to move the first plate between a first position, a second position and a third position along the shaft;

wherein the first plate positioned in the first position and rotating in the first rotational direction causes the first portion of the pin to travel in front of the wire aperture;

wherein the first plate positioned in the second position and rotating in the first rotational direction causes the second portion of the pin to travel in front of the wire aperture;

wherein the first plate positioned in the third position and rotating in the first rotational direction causes the pin to travel underneath the wire aperture.

11. The device of claim 10, further comprising:

a pair of opposing wheels positioned for feeding wire through the wire aperture, wherein the first plate positioned in the first position and rotating in the first rotational direction causes the first portion of the pin to bend the wire fed through the wire aperture against the first bend surface, and wherein the first plate positioned in the second position and rotating in the first rotational direction causes the second portion of the pin to bend the wire fed through the wire aperture against the first bend surface.

12. The device of claim 11, wherein the first plate positioned in the third position and rotating in the second rotational direction causes the pin to pass underneath and not engage with the wire fed through the wire aperture.

13. A device for bending wire, comprising:

a first plate that includes:

upper and lower surfaces with a center aperture extending there between, and a cavity formed in the upper surface that includes opposing sidewalls extending up from a bottom surface of the cavity, wherein a separation of the opposing sidewalls decreases as the opposing sidewalls extend towards the center aperture, and wherein a separation of the opposing sidewalls decreases as the opposing sidewalls extend up from the bottom surface of the cavity;

a pin assembly configured for insertion in the cavity, wherein the pin assembly includes:

a second plate having opposing side surfaces and top and bottom surfaces, a pin extending from the top surface and adjacent a first end of the second plate, wherein a separation of the opposing side surfaces decreases as the opposing side surfaces extend towards the first end, and wherein a separation of the opposing side surfaces decreases as the opposing side surfaces extend up toward the top surface, and wherein upon insertion of the pin assembly in the cavity, the opposing side surfaces configured to engage with the opposing sidewalls;

a shaft extending through the center aperture and terminating in a bend head, wherein the bend head includes:

a wire aperture configured to pass a wire, and first and second bend surfaces positioned adjacent the wire aperture;

a first motor configured to rotate the first plate about the shaft in opposing first and second rotational directions.

14. The device of claim 13, wherein:

the cavity includes a distal wall that extends upwardly from the bottom surface of the cavity as the distal wall extends away from the center aperture, the second plate includes a bottom surface having first portion engaged with the bottom surface of the cavity and a second portion engaged with the distal wall upon insertion of the pin assembly in the cavity.

15. The device of claim 13, wherein with the pin assembly inserted in the cavity, the device further comprising:

a second motor configured to move the first plate between a first position and a second position along the shaft;

wherein the first plate positioned in the first position and rotating in the first rotational direction causes the pin to travel in front of the wire aperture;

wherein the first plate positioned in the second position and rotating in the first rotational direction causes the pin to travel underneath the wire aperture.

16. The device of claim 15, further comprising:

a pair of opposing wheels positioned for feeding wire through the wire aperture, wherein the first plate positioned in the first position and rotating in the first rotational direction causes the pin to bend the wire fed through the wire aperture against the first bend surface.

17. The device of claim 16, wherein the first plate positioned in the second position and rotating in the second rotational direction causes the pin to pass underneath and not engage with the wire fed through the wire aperture.

18. The device of claim 13, wherein the pin has a first portion with a first radius of curvature and a second portion with a second radius of curvature different than the first radius of curvature.

19. The device of claim 18, wherein with the pin assembly inserted in the cavity, the device further comprising:

a second motor configured to move the first plate between a first position, a second position and a third position along the shaft;

wherein the first plate positioned in the first position and rotating in the first rotational direction causes the first portion of the pin to travel in front of the wire aperture;

wherein the first plate positioned in the second position and rotating in the first rotational direction causes the second portion of the pin to travel in front of the wire aperture;

wherein the first plate positioned in the third position and rotating in the first rotational direction causes the pin to travel underneath the wire aperture.

20. The device of claim 19, further comprising:

a pair of opposing wheels positioned for feeding wire through the wire aperture, wherein the first plate positioned in the first position and rotating in the first rotational direction causes the first portion of the pin to bend the wire fed through the wire aperture against the first bend surface, and wherein the first plate positioned in the second position and rotating in the first rotational direction causes the second portion of the pin to bend the wire fed through the wire aperture against the first bend surface.

21. The device of claim 20, wherein the first plate positioned in the third position and rotating in the second rotational direction causes the pin to pass underneath and not engage with the wire fed through the wire aperture.

* * * * *